US009057150B2

(12) United States Patent
Zattin et al.

(10) Patent No.: US 9,057,150 B2
(45) Date of Patent: Jun. 16, 2015

(54) LAUNDRY WASHING APPLIANCE WITH DOSING DISPENSER

(75) Inventors: Andrea Zattin, Solesino (IT); Elisa Stabon, Fosso' (IT); Maurizio Del Pos, Pordenone (IT); Mario Filippetti, Campoformido (IT)

(73) Assignee: Electrolux Home Products Corporation N.V., Brussel (BE)

( * ) Notice: Subject to any disclaimer, the term of this patent is extended or adjusted under 35 U.S.C. 154(b) by 540 days.

(21) Appl. No.: 13/319,909

(22) PCT Filed: Apr. 29, 2010

(86) PCT No.: PCT/EP2010/055835

§ 371 (c)(1),
(2), (4) Date: Dec. 9, 2011

(87) PCT Pub. No.: WO2010/130586

PCT Pub. Date: Nov. 18, 2010

(65) Prior Publication Data

US 2012/0096901 A1 Apr. 26, 2012

(30) Foreign Application Priority Data

May 11, 2009 (EP) ..... 09159847

(51) Int. Cl.
*D06F 39/02* (2006.01)

(52) U.S. Cl.
CPC ..... *D06F 39/022* (2013.01); *D06F 39/02* (2013.01)

(58) Field of Classification Search
None
See application file for complete search history.

(56) References Cited

U.S. PATENT DOCUMENTS

2009/0100881 A1* 4/2009 Dahlke ..... 68/17 R

FOREIGN PATENT DOCUMENTS

| | | |
|---|---|---|
| DE | 32 46 127 | 6/1984 |
| DE | 601 29 609 | 5/2008 |
| EP | 0 528 768 | 2/1993 |
| EP | 1 690 972 | 8/2006 |

(Continued)

OTHER PUBLICATIONS

International Search Report mailed Oct. 26, 2010 in corresponding International Application No. PCT/EP2010/055835.

(Continued)

*Primary Examiner* — Joseph L Perrin
*Assistant Examiner* — Levon J Shahinian
(74) *Attorney, Agent, or Firm* — Banner & Witcoff, Ltd.

(57) ABSTRACT

A laundry washing appliance (100) includes a cabinet (105) accommodating a laundry washing tub and a dispensing arrangement for dispensing laundry washing treatment products to be used during laundry washing. The dispensing arrangement includes a drawer (125) slidable within a seat (227) provided in the cabinet (105). The drawer (125) defines at least one container (201*a*, 201*b*) for laundry washing treatment products. At least one suction pump (265*a*, 265*b*, 365*a*, 365*b*) is associated with the at least one container (201*a*, 201*b*) and is fluidly connected to the laundry washing tub for delivering thereto dosed amounts of the treatment products. Suction pipes (213*a*, 213*b*, 331) are connected between the at least one suction pump (265*a*, 265*b*, 365*a*, 365*b*) and the at least one container (201*a*, 201*b*). The at least one suction pump (265*a*, 265*b*, 365*a*, 365*b*) and the suction pipes (213*a*, 213*b*, 331) are arranged so as to enable the suction of the dosed amounts of treatment product from above a surface of the treatment product contained in the container (201*a*, 201*b*).

15 Claims, 17 Drawing Sheets

(56) References Cited

FOREIGN PATENT DOCUMENTS

| | | |
|---|---|---|
| EP | 1 884 584 | 2/2008 |
| EP | 2 011 913 | 1/2009 |
| WO | 2008/010671 | 1/2008 |
| WO | 2008000612 A1 | 1/2008 |

OTHER PUBLICATIONS

Extended European Search Report dated Oct. 14, 2009 in related European Application No. 09159846.6.
International Search Report mailed Sep. 17, 2010 in related International Application No. PCT/EP2010/055642.
Office Action issued on Mar. 13, 2014 in corresponding Russian Application No. 2011150208.

* cited by examiner

LAUNDRY WASHING APPLIANCE WITH DOSING DISPENSER

BACKGROUND OF THE INVENTION

1. Field of the Invention

The present invention relates in general to laundry washing appliances, such as laundry washers or combined laundry washers and dryers. The term "laundry" is here intended to include clothes and garments. In particular, the present invention relates to a laundry washing appliance having an auto-dosing dispensing arrangement for the laundry washing treatment liquids (e.g., detergents, softeners and the like).

2. Description of the Related Art

Laundry washing appliances like laundry washers and combined washers and dryers make use of laundry washing treatment products in the laundry washing cycle; such treatment products include for example detergents and softeners.

The laundry washing appliances generally include receptacles for the laundry treatment products, for example in the form of drawers provided in the appliance cabinet, from where, during the laundry washing cycle, the treatment products are taken and dispensed into the washing tub.

In recent years, the trend has been towards using liquid treatments products, instead of powder ones as in past years. However, the solutions for dispensing the laundry treatment products into the washing tub remained essentially unchanged, despite the evolution in the treatment products typologies and composition, and despite the reductions in the water consumption of the laundry washing appliances.

Auto-dosing dispensing of laundry treatment products to be used during a washing cycle is believed to be advantageous in several respects. For example, it would translate into a reduction of time and efforts of the users, which would be levied from the burden of dosing the correct amount of laundry treatment products, and would beneficially reflect on the environment pollution, because wastes would be reduced or eliminated.

Auto-dosing dispensing of the treatment products in liquid form has proved to be far easier compared to powder products. However, known treatment products dispensing systems are not suitable for liquid treatment products.

EP 1690972 discloses a softener-dosing container for electrical household appliances, having an upper casing positioned above the mixing compartment or drawer wherein the cleaning products are introduced. The dispensing reservoir comprises a watertight, hermetically sealed tray of large capacity, partially or totally removable with respect to a cavity defined in the upper casing and it has a drain hole for the passage of fabric softener to the drawer with the intermediation of a gear pump, in addition to incorporating a portion adjacent to the tray which forms part of the casing which includes electrical components to operate a motor which, through a transmission and by means of magnetized plates, determines the rotation of the pump positioned in the removable tray to push the fabric softener to the drawer. The body of the pump has an outlet gasket equipped with a discharge opening to push the fabric softener to the mixing compartment or drawer; a non-return valve is provided in correspondence with the discharge opening consisting of a sphere pressed by a spring which covers the discharge opening or leaves free passage for the discharge of the fabric softener once the spring pressure is exceeded.

SUMMARY OF SELECTED INVENTIVE ASPECTS

The Applicant observes that the solution disclosed in EP 1690972 is not fully satisfactory. Since the softener falls by gravity through the discharge opening, despite the presence of the non-return valve leakages of softener may occur, which is undesirable.

The Applicant has tackled the problem of finding an effective solution to the problem of providing an arrangement for auto-dosing of laundry treatment products in laundry washing appliances.

According to an aspect of the present invention, a laundry washing appliance is provided, comprising a cabinet accommodating a laundry washing tub and a dispensing arrangement for dispensing laundry washing treatment products to be used during laundry washing.

The dispensing arrangement comprises a drawer slidable within a seat provided in the cabinet, the drawer defining at least one container for laundry washing treatment products.

At least one suction pump is provided, associated with the at least one container and fluidly connected to the laundry washing tub for delivering thereto dosed amounts of the treatment products.

A fluid connection between the at least one suction pump and the at least one container is provided.

The at least one suction pump and the fluid connection are arranged so as to enable the suction of the dosed amounts of treatment product from above a surface of the treatment product contained in the container.

The at least one suction pump may be arranged so that in operation it results in the suction of the dosed amounts from above a surface level of the treatment product contained in the at least one container.

The at least one suction pump may comprise a pump motor part and a pump body part separable from one another; in an embodiment of the invention, the pump motor part is mounted to the drawer seat, and the pump body part is mounted to the drawer.

The pump motor part may be mounted at a rear of the drawer seat, and the pump body part may be mounted at a rear of the drawer.

The dispensing arrangement may comprise a mixing chamber, the at least one suction pump associated with the at least one container being fluidly connected to the mixing chamber for delivering thereto dosed amounts of the treatment products, the mixing chamber being fluidly connected to a water inlet and to the laundry washing tub.

The laundry washing appliance may comprise a water feed channel connected to an outlet of at least one electrovalve which in use is connectable to an external water main, the water feed channel being fluidly connected to the mixing chamber.

The at least one suction pump associated with the at least one container may be fluidly connected to the water load chamber for delivering thereto dosed amounts of the treatment products sucked from the at least one container.

The water load chamber may comprise a first sub-chamber, whereinto fresh water is loadable, and a second sub-chamber, where the dosed amounts of treatment products delivered by the at least one pump are discharged, the first and second sub-chambers being partially separated from one another.

The mixing chamber may be interposed between the pump motor part and the pump body part.

The mixing chamber and/or the water load channel are preferably in single-piece construction with the drawer seat.

The at least one suction pump may be a positive displacement pump.

In embodiments of the invention, the pump motor part comprises an electric motor and a drive axle.

The pump body part may comprise a motion transmission axle configured to releasably engage the drive axle; a piston driven by the motion transmission axle and movable within a pump chamber; a first non-return valve at an intake of the suction pump, and a second non-return valve at a delivery outlet of the suction pump. The first and second non-return valves may be caused to open and close in phase opposition by pressure deltas caused by the movement of the piston within said pump chamber.

The laundry washing appliance may comprise at least one valve for fluidly connecting the at least one container to the at least one suction pump, said valve being realized so as to automatically close and cut off the fluid connection between the at least one container and the at least one suction pump when the drawer is even partially extracted from the seat, and to automatically open and establish the fluid connection between the at least one container and the at least one suction pump when the drawer is pushed into the seat.

The at least one valve may comprise at least a valve portion that is attached to the drawer seat, said valve portion being arranged at the top of the drawer seat, so that the drawer is slidable within the seat below the at least one valve.

Said at least one valve may comprise:

at least one valve body;

at least one fluid passage cut-off member movable within the valve body between a first position in which the fluid passage is cut off, and a second position in which the fluid passage is enabled;

a respective bias member associated with the at least one fluid passage cut-off member for biasing it into the first position when the drawer is even partially extracted from the seat, and a push member for pushing the bias member into the second position against the action of the bias member when the drawer is pushed into the seat.

BRIEF DESCRIPTION OF THE DRAWINGS

These and other features and advantages of the present invention will be made apparent by the following detailed description of some exemplary and non-limitative embodiments thereof. For best intelligibility of the description, reference should be made to the attached drawings, wherein:

FIGS. 2A-2L show a solution according to an embodiment of the present invention, and in particular:

FIG. 2A shows in perspective view the drawer for pouring laundry treatment products, in a partially pulled-out, open condition;

FIG. 2B shows, in perspective from a different angle, the drawer of FIG. 2A fully extracted from a respective seat provided in a cabinet of the laundry washing appliance;

FIG. 2C is a partial cross-sectional view taken along plane II-C-II-C of FIG. 2A;

FIG. 2D shows the drawer of FIG. 2A in a closed condition (fully pushed into its seat);

FIG. 2E is a partial cross-sectional view taken along plane II-E-II-E of FIG. 2D;

FIG. 2F is a perspective view from the rear of the drawer and seat assembly;

FIG. 2G is a perspective and exploded view of a bottom part of the drawer seat;

FIG. 2H is a top view of the rear part of the drawer seat;

FIG. 2L is a cross-sectional view of the drawer seat taken along plane II-L-II-L of FIG. 2H (with the pipes to/from the pumps not shown for better intelligibility);

FIGS. 3A-3L show a solution according to another embodiment of the present invention, and in particular:

FIG. 3A shows in perspective view the drawer for pouring laundry treatment products partially extracted from its seat;

FIG. 3B shows in perspective the drawer fully inserted into its seat;

FIG. 3C shows in perspective the detail of a dosing pump for delivering dosed amounts of laundry washing treatment products to a washing tub;

FIG. 3D shows the dosing pump, in a perspective similar to FIG. 3C and in partial cross-section, in a first operating condition;

FIG. 3E is a front view of the perspective view of FIG. 3D;

FIG. 3F shows the dosing pump, in a perspective and in partial cross-section similarly to FIG. 3C, in a second operating condition;

FIG. 3G is a front view of the perspective view of FIG. 3F;

FIG. 3I shows in perspective and partially in cross-section the dosing pump, in the second operating condition;

FIG. 3H is a perspective view of the drawer seat; and

FIG. 3L shows in perspective a cross-section of the drawer seat taken along a horizontal plane.

DETAILED DESCRIPTION OF EMBODIMENTS OF THE INVENTION

Figure 1:
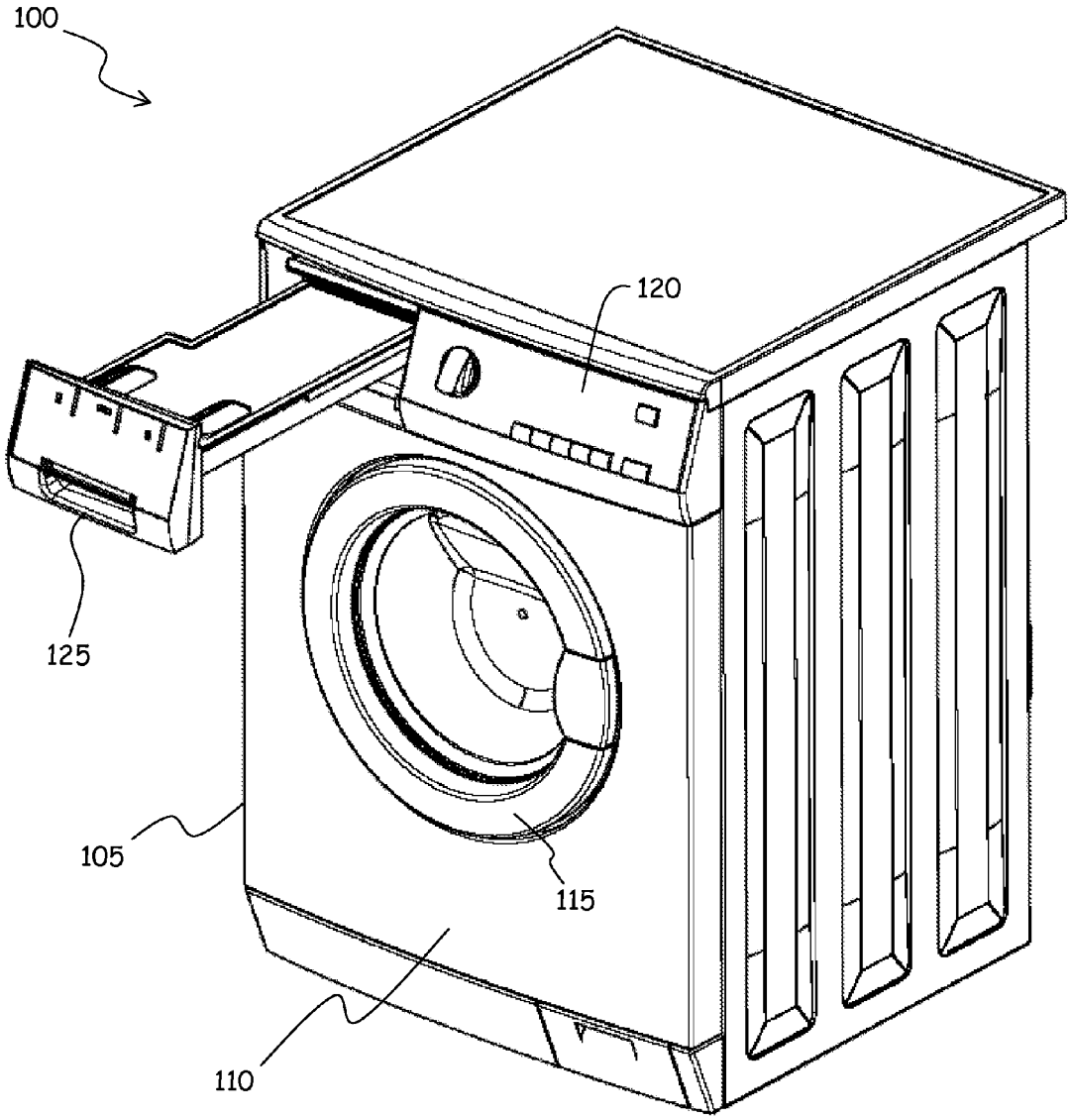
FIG. 1 is a perspective view of a laundry washing appliance where solutions according to embodiments of the present invention are implemented, provided with a drawer for pouring laundry treatment products.

Making reference to the drawings, in FIG. 1 there is shown a laundry washing appliance 100 according to an embodiment of the present invention. In particular, the laundry washing appliance 100 is, in the considered example, a laundry washer, nevertheless the solutions that will be described hereinafter can be applied as well and straightforwardly to other types of laundry washer appliances, for example to combined laundry washers and driers.

The laundry washer 100 comprises an external cabinet 105, within which a washing tub accommodating a rotating washing drum is housed (neither the washing tub, nor the drum are visible in the drawing, being per-se conventional and not relevant for the understanding of the invention embodiments to be described). A front wall 110 of the cabinet 105 is provided with an aperture with which there is associated a door 115, for enabling the user to access the washing drum so as to load/unload the items to be washed. Frontally to the cabinet 105, essentially at the top thereof, a machine control panel 120 is provided, with operational input and setting devices (like for example pushbuttons, rotary selectors and the like) through which the user can set the desired washing preferences, and display devices.

The laundry washer 100 is equipped with a dispensing arrangement for dispensing laundry washing treatments products, e.g. detergents and softeners, to the washing tub. The dispensing arrangement comprises, located aside the control panel 120, a drawer 125, slidably accommodated in a drawer seat (denoted 227 in the following figures and described in detail later on) provided in the cabinet 105 and extending essentially from the front to the rear of the machine; the drawer, as will be described in the following, is intended to be exploited by the user for loading laundry washing treatments products to be used during laundry washing cycles.

In the following, exemplary and non-limitative solutions are described for the treatment products dispensing arrangement.

Figure 2A:
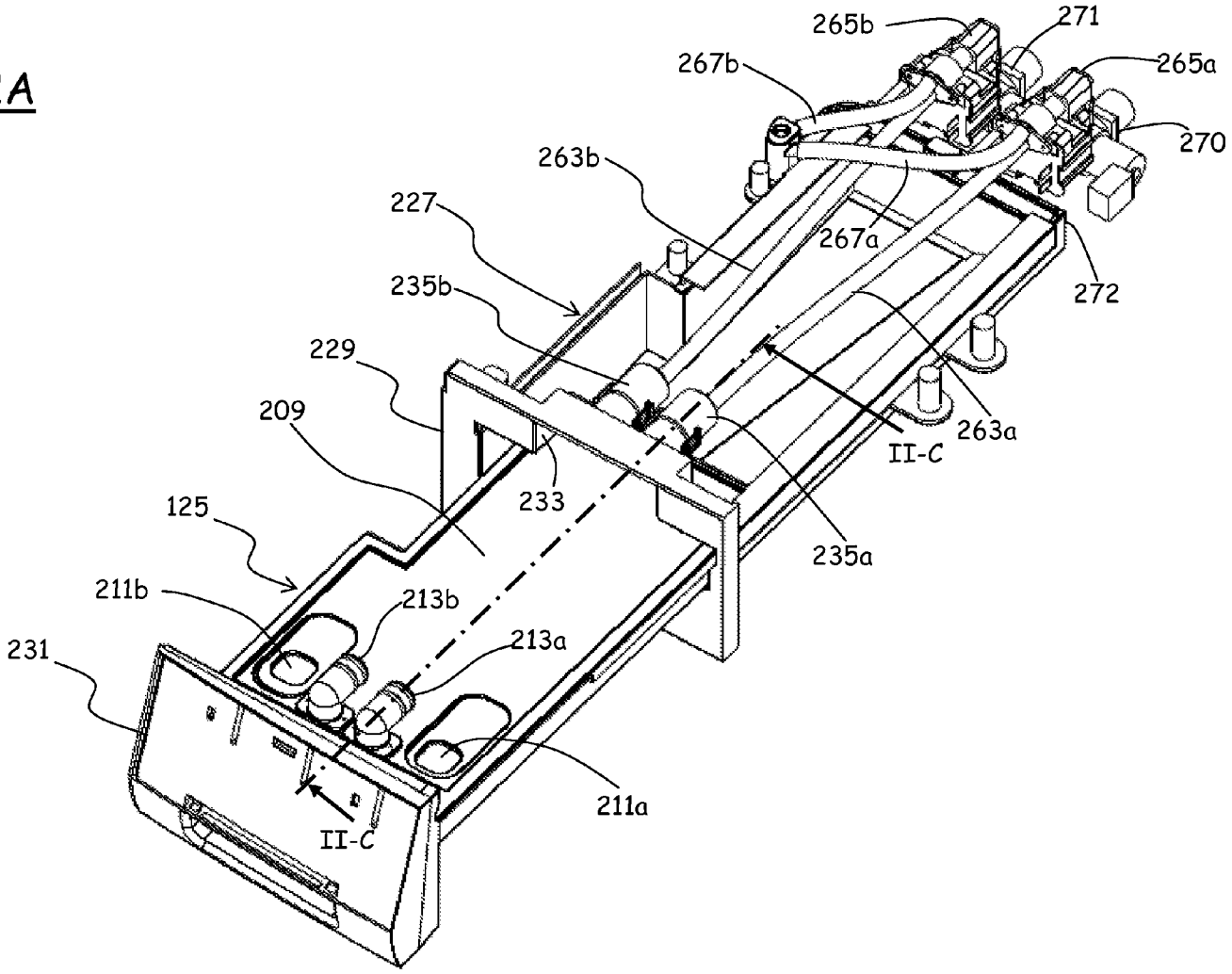
Figure 2B:
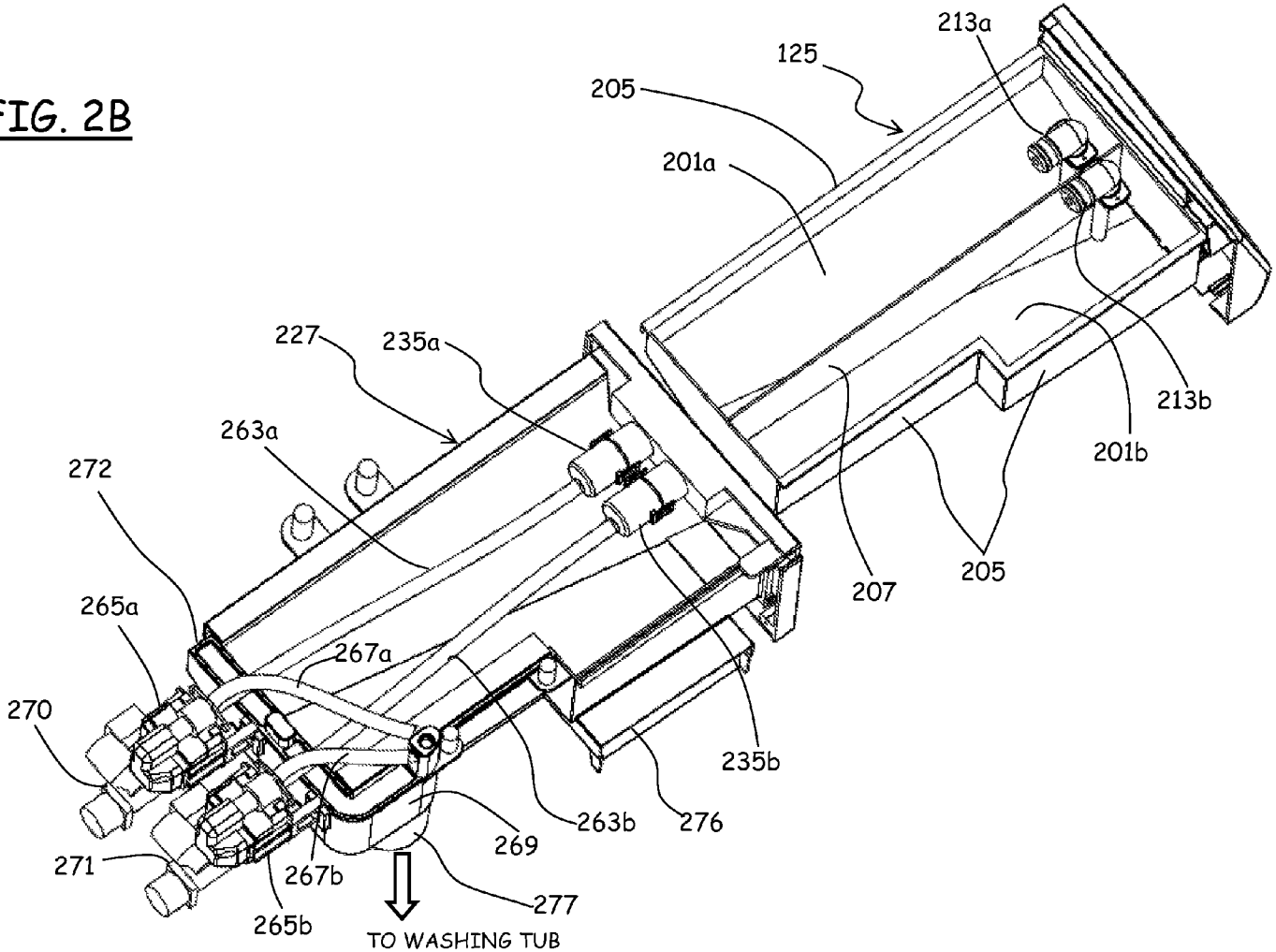
Figure 2C:
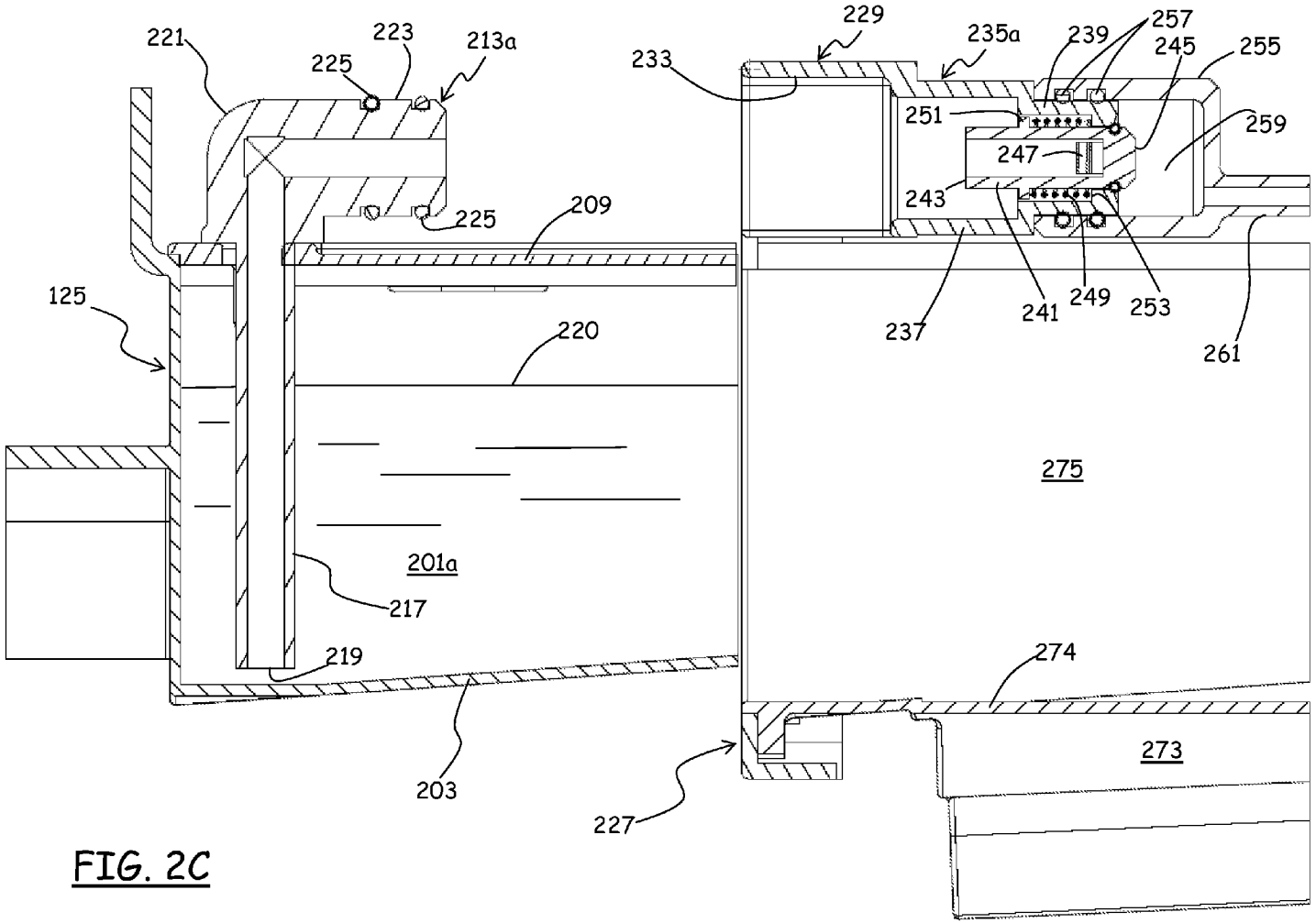
Figure 2D:
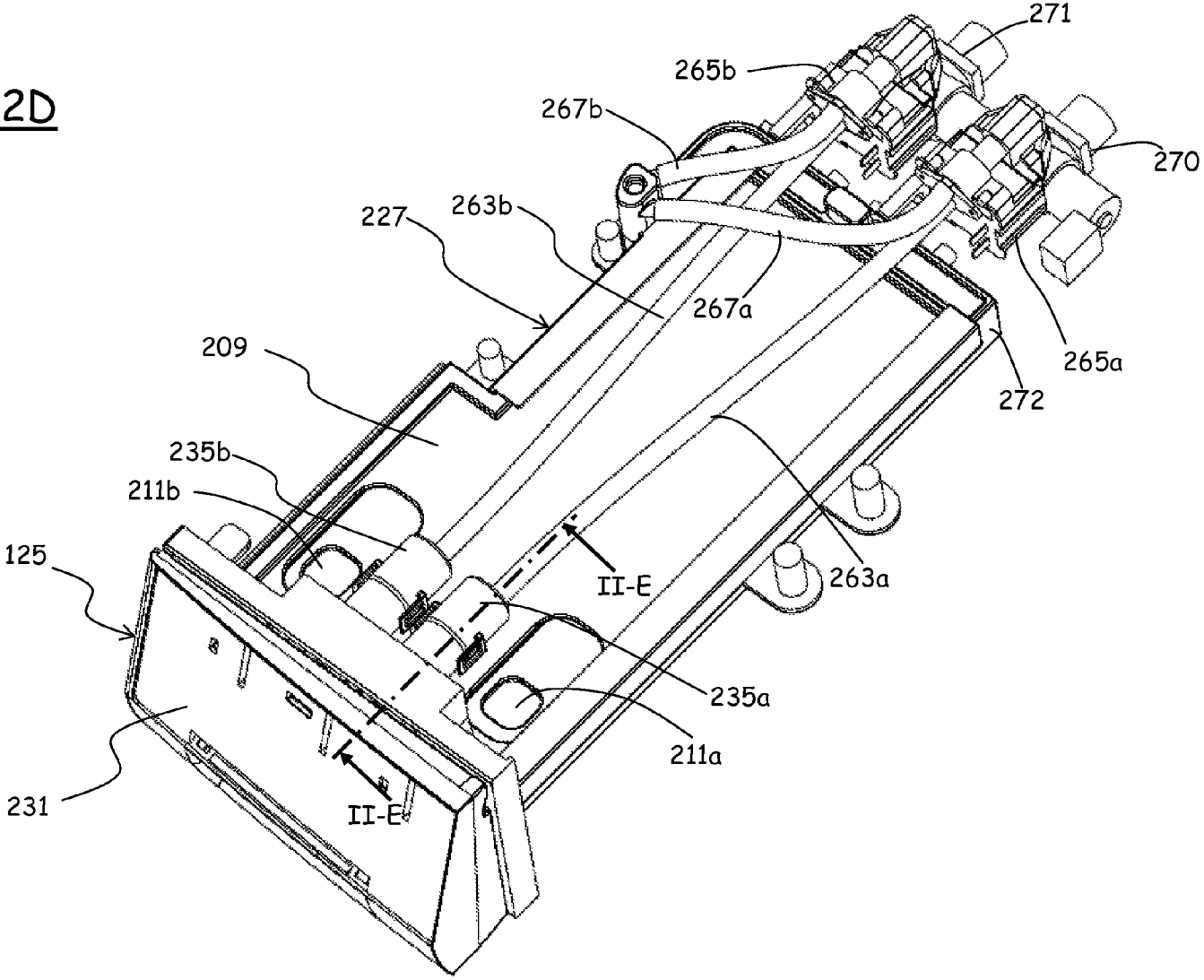
Figure 2E:
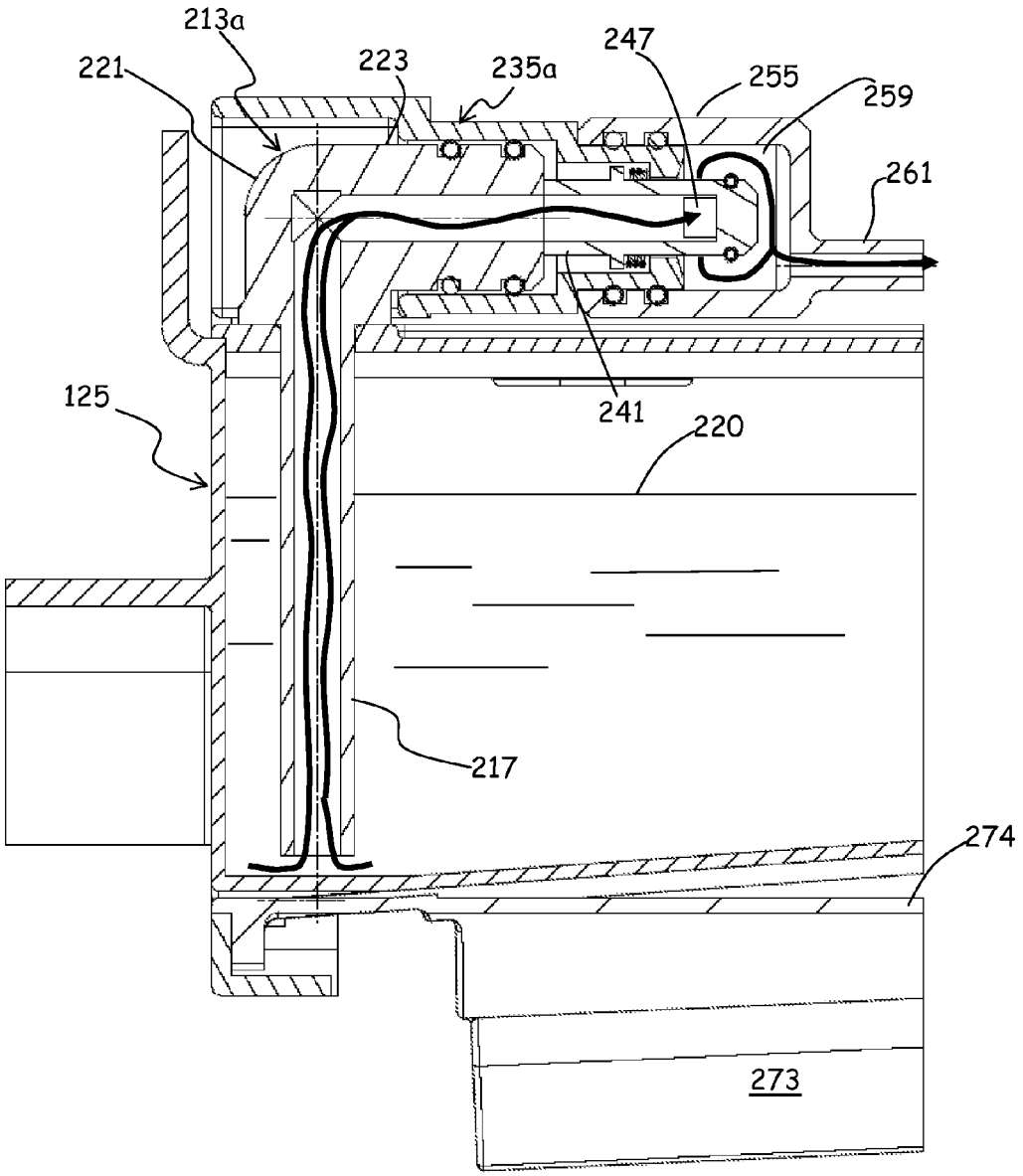
Figure 2F:
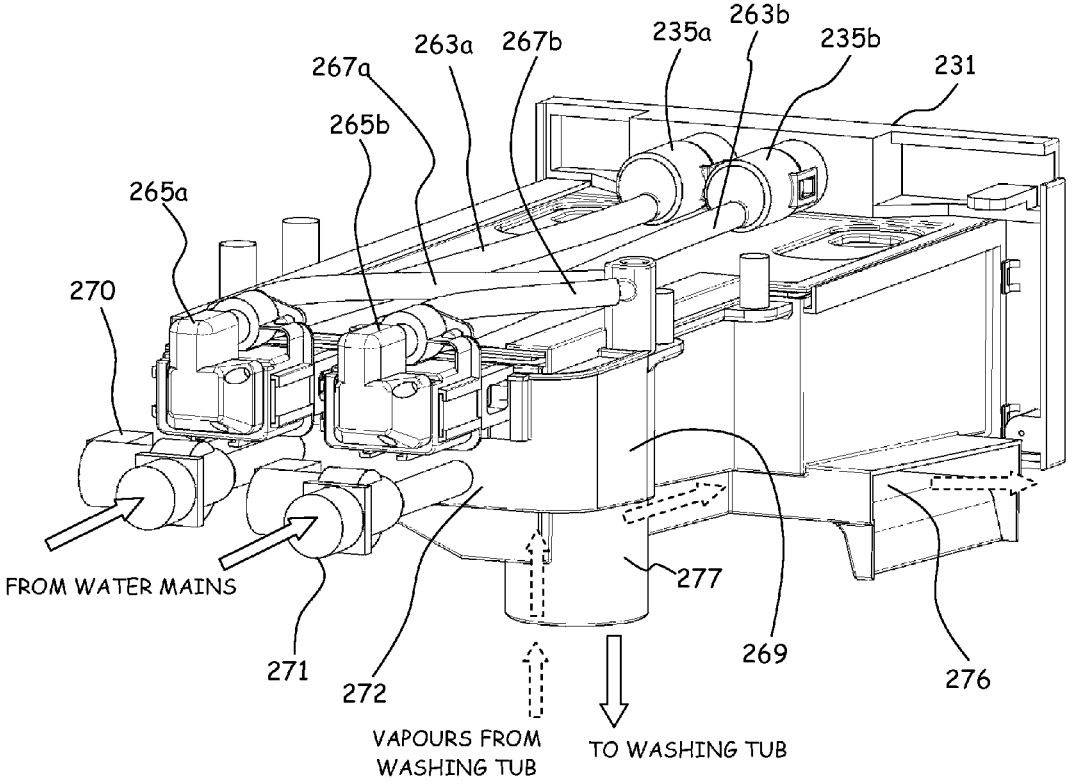
Figure 2G:
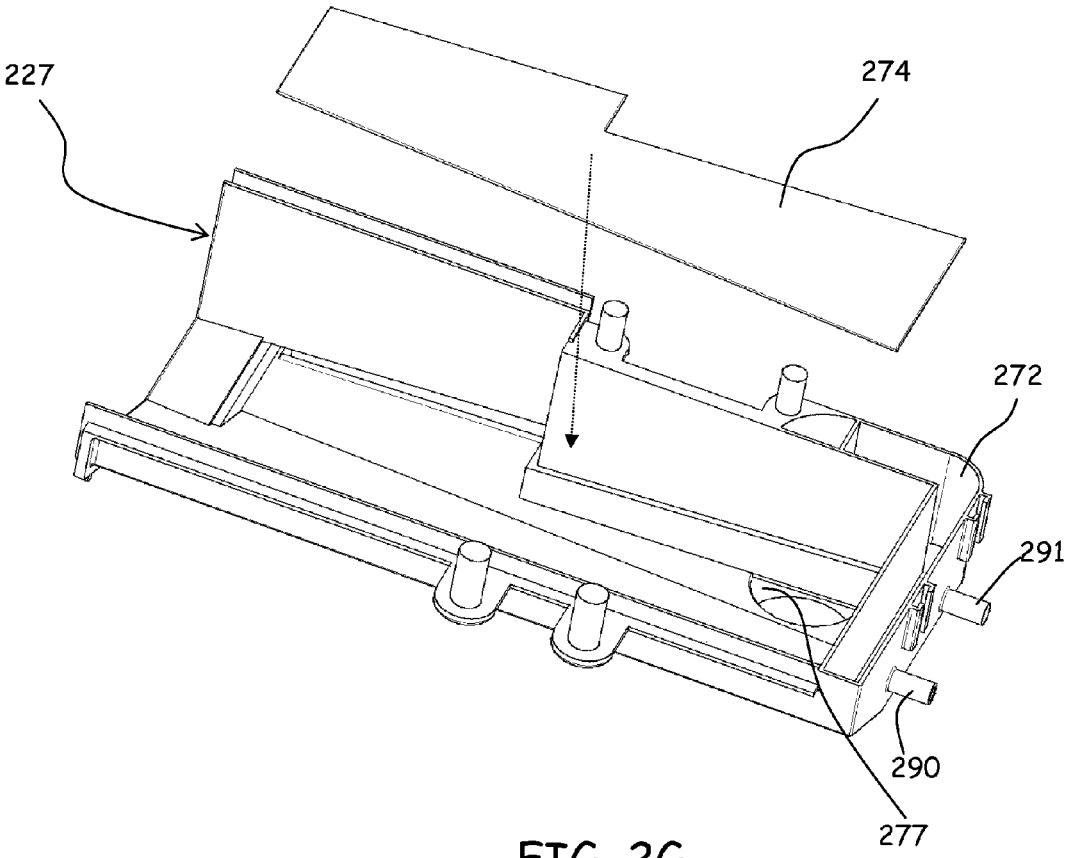
Figure 2H:
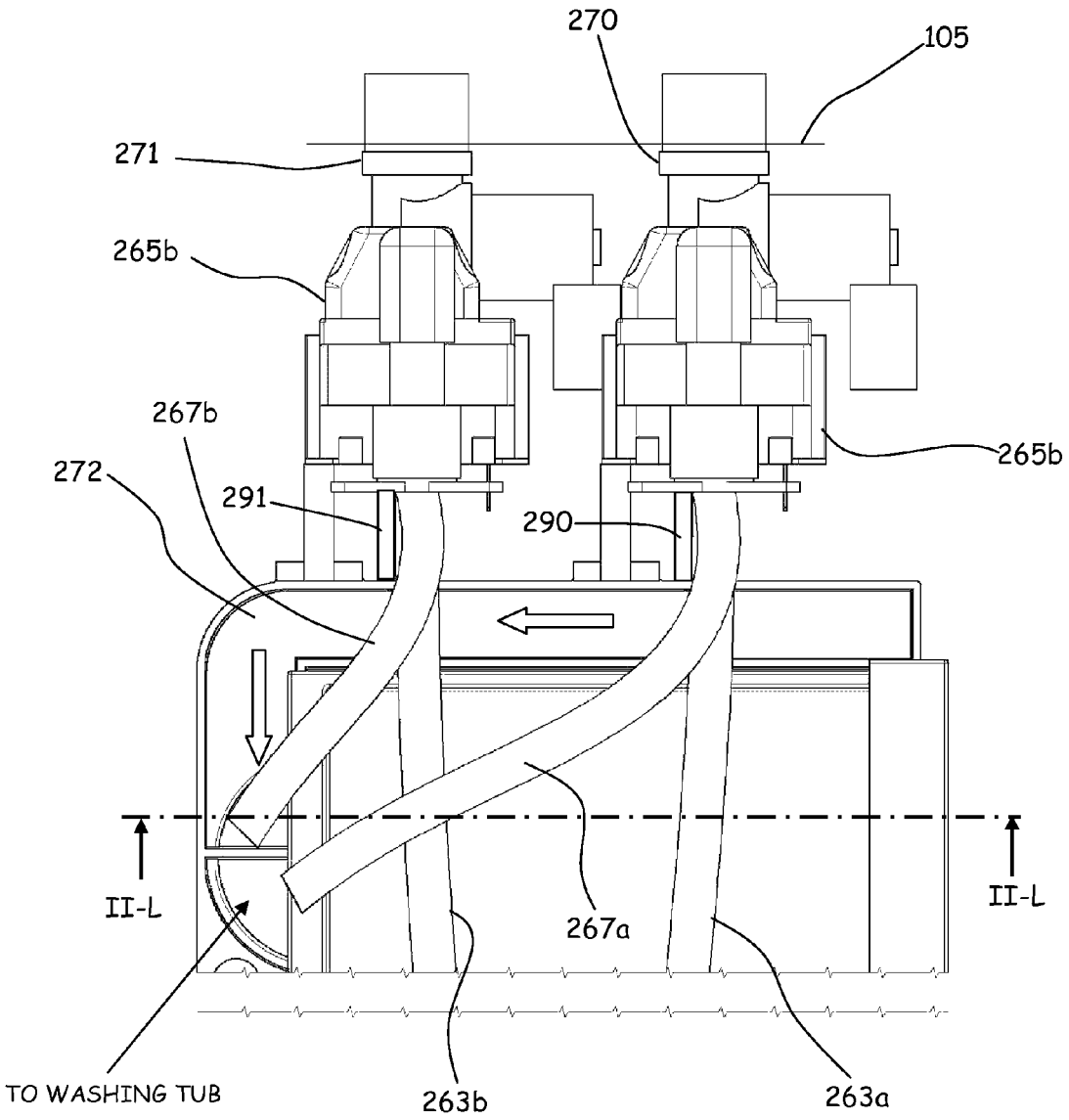
Figure 2L:
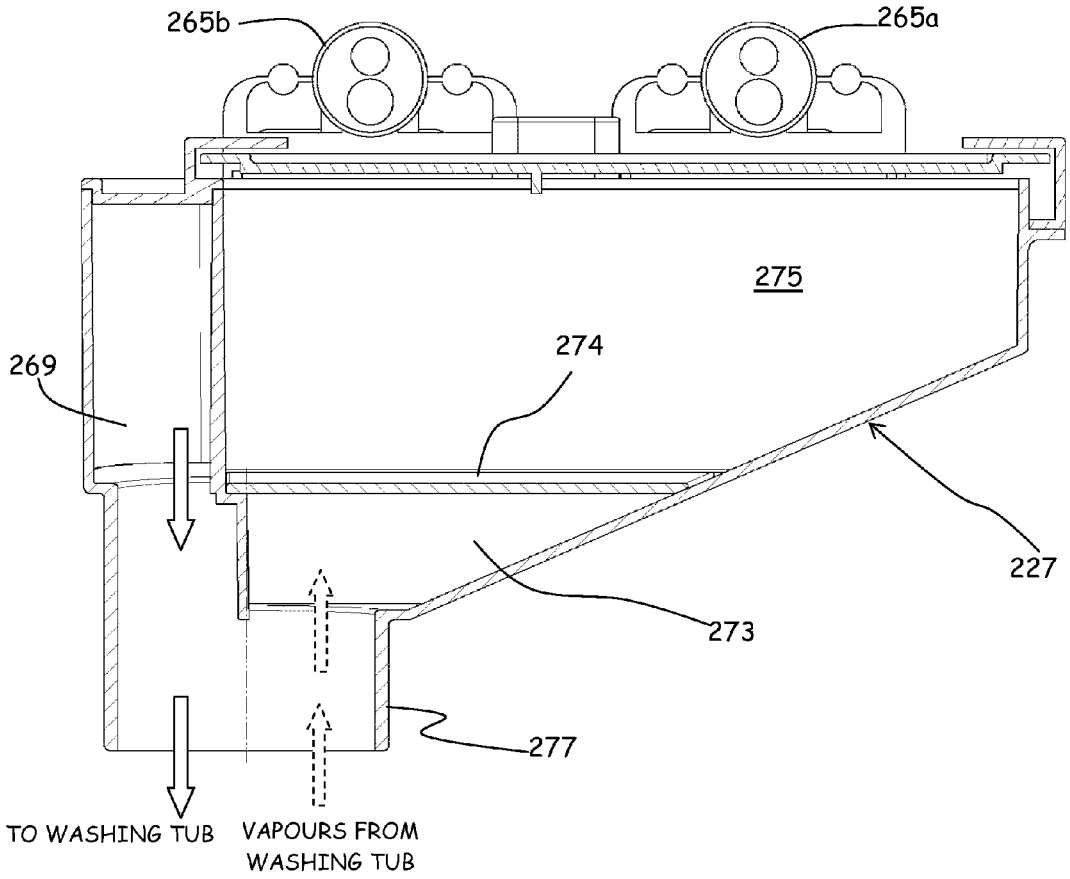

A first solution is shown in FIGS. 2A-2L. In greater detail, FIG. 2A shows in perspective view the drawer 125 in a partially pulled-out, open condition (partially extracted from its seat); FIG. 2B shows, in perspective from a different angle, the drawer 125 fully extracted from the seat; FIG. 2C is a partial cross-sectional view taken along plane II-C-II-C of FIG. 2A; FIG. 2D shows the drawer 125 in a closed condition (wherein the drawer 125 is fully pushed into its seat); FIG. 2E is a partial cross-sectional view taken along plane II-E-II-E of FIG. 2D; FIG. 2F is a perspective view from the rear of the drawer and seat assembly; FIG. 2G is a perspective and exploded view of a bottom part of the drawer seat; FIG. 2H is a top view of the rear part of the drawer seat; and FIG. 2L is a cross-sectional view of the drawer seat taken along plane II-L-II-L of FIG. 2H (with some components not shown for better intelligibility).

The drawer 125 is shaped so as to define two containers 201*a* and 201*b* (visible in FIG. 2B) for two different laundry washing treatments products in liquid form; for example, the container 201*a*, of higher capacity, is for the washing detergent, and the container 201*b* is for the softener. The two containers 201*a* and 201*b* are defined by the drawer bottom wall 203 and by the drawer lateral, perimetral walls 205, and are separated by an intermediate wall 207 rising from the bottom wall 203 of the drawer 125 and extending the whole length thereof. The drawer bottom wall 203 is inclined towards the drawer front, so that the height of the two containers 201*a* and 201*b* decreases going from the drawer front towards the rear thereof. The two containers 201*a* and 201*b* are open at the top, and a (preferably) removable cap 209 is provided for closing the two containers (by removing the cap 209, the user may gain access to the containers for, e.g., cleaning purposes). In the cap 209, load apertures 211*a* and 211*b* are provided, one over each of the containers 201*a* and 201*b*, for pouring the proper treatment product into the containers.

Associated to the cap 209 are two suction pipes 213*a* and 213*b*, one in correspondence of the detergent container 201*a* and the other in correspondence of the softener container 201*b*. The suction pipes 213*a* and 213*b*, one of which (213*a*) is visible in the cross-sectional views of FIGS. 2C and 2E, comprise each a vertical pipe portion 217 penetrating into the respective container substantially down to the bottom thereof (so that, when the container 201*a* or 201*b* is filled with the proper treatment product, an aperture 219 at the bottom of the vertical pipe portion 217 is located well below the level of the treatment product surface 220), and an elbow portion 221 positioned over the cap 209; on a free end portion 223 of the elbow portion 221, a pair of O-rings 225 are fit in respective annular notches.

The drawer seat, overall denoted 227, is shaped so as to slidably accommodate the drawer 125 and guide the drawer in the extraction/insertion movements. The drawer seat 227 comprises a front frame 229 for the abutment of a drawer front panel 231; the front frame 229 has a recess 233 formed in a top side thereof, the recess 233 being adapted to allow the passage of the elbow portions 221 of the two suction pipes 213*a* and 213*b* when the drawer 125 is fully pushed into the cabinet 105 (a condition in which the drawer front panel 231 results essentially flush with the control panel 120).

Two valves are formed in the drawer seat 227. Each of the two valves comprises a hollow valve body 235*a*, 235*b* protrudring from the front frame 229 towards the rear of the cabinet 105; the two valve bodies 235*a* and 235*b*, which in the shown exemplary embodiment are formed in one piece with the front frame 229, are positioned so as to result aligned to the elbow portions 221 of the two suction pipes 213*a* and 213*b*, and have a first portion 237 of shape and size adapted to tightly receive therein the free end portion 223 of the elbow portions 221 of the suction pipes 213*a* and 213*b*, the O-rings 225 provided on the free end portion 223 ensuring a tight seal when the free end portions 223 of the elbow portions 221 are inserted into the first portion 237 of the valve bodies 235*a* and 235*b*. The valve bodies 235*a* and 235*b* have a second portion 239 following the first portion 237 and accommodating a slidable valve member 241 forming a fluid passage cut-off element. The slidable valve member 241 is a hollow, generically cylindrical member, open at a first base 243 thereof facing the elbow portions 221, and closed at an opposite, second base 245, with one or more apertures 247 formed in the perimetral wall thereof in correspondence of the second base 245, the aperture(s) 247 putting the hollow interior of the valve member 241 into fluid communication with the exterior. A bias helical spring 249 is fit outside the valve member, between an annular ridge 251 projecting from the valve member 241 perimetral wall and a shoulder 253 formed at the end of the second portion 239 of the valve bodies 235*a* and 235*b*.

A pipe coupling 255 is fit onto the second portion 239 of the valve bodies 235*a* and 235*b*, with a couple of O-rings 257 fit on each of the valve body second portions 239 for ensuring the seal; the pipe coupling 255 extends farther towards the rear of the cabinet 105 with respect to the second portion 239 of the valve bodies 235*a* and 235*b*, to define a liquid chamber 259, and terminates with a nipple 261 adapted to the connection of a flexible pipe 263*a*, 263*b* leading to the intake of a respective suction pump 265*a*, 265*b*.

According to an embodiment of the present invention, the two pumps 265*a* and 265*b* are positive displacement pumps, for example volumetric pumps, reciprocating pumps, gear pumps, and are adapted to displace dosed amounts of liquids. The two pumps 265*a* and 265*b* have each a delivery outlet which is fluidly connected, by means of a respective flexible pipe 267*a* and 267*b*, to respective inlets of a mixing chamber 269, located at a rear corner (in particular, but not limitatively, the rear left corner as seen from the front) of the seat 227 for the drawer 125; preferably the mixing chamber 269 is in a single-piece construction with the drawer seat 227, and is obtained by a plastic injection-moulding process.

Outlets of two electrovalves 270 and 271 are fluidly connected, through respective conduits 290 and 291, to a water load chamber 272, located behind the drawer seat 227 and for example in one piece therewith. The water load chamber 272 is shaped so as to define a channel that turns around the rear left corner of the drawer seat 227 and opens into the mixing chamber 269. The two electrovalves 270 and 271 are respectively connectable, by means of hoses, to a cold water and a hot water delivery ports intended to be present in the premises of the user where the appliance is to be located (in alternative embodiments of the invention, only one electrovalve may be present, for the connection to the cold water or hot water delivery port). Preferably, the conduits 290 and 291 are formed in a single-piece construction with the water load chamber 272, and are obtained by a plastic injection-moulding process. The two electrovalves are for example attached to the rear of the water load chamber by means of brackets. The water load chamber 272 forms an air gap (air break) between the outlets of the electrovalves and the mixing chamber 269.

The mixing chamber 269 opens at the bottom into a manifold 277 which is in fluid communication with the washing tub (for example, to this purpose a flexible hose, a bellow—not shown in the drawings—may be used), for delivering thereto the washing water, possibly mixed with the laundry treatment products, and the rinsing water.

Level sensors (not shown in the drawings) for sensing the level of laundry treatment products may be provided within, or be operatively associated with the two containers 201*a* and 201*b*. The level sensors, which may for example be one or more capacitive sensors, optical sensors, conductivity sensors, and may be mounted on the drawers, or on the drawer seat, for example along the side walls thereof, are used to provide the user with indications (for example, through visual indicators provided on the control panel 120) about the necessity of refilling the containers 201*a* and 201*b*.

An air space 273 is formed at the bottom of the drawer seat 227; the air space 273 is for example defined by the bottom walls of the drawer seat 227 and a (possibly removable, or formed in one piece with the drawer seat) panel 274 that separates the air space 273 at the bottom of the drawer seat 227 from the upper area 275 of the drawer seat 227 intended to accommodate the drawer 125. The air space 273 is in air communication with the washing tub, for example through the flexible hose or bellow that connects the manifold 277 to the washing tub). The air space 273 has a discharge aperture 276, that opens within the machine cabinet 105.

The user may extract the drawer 125 from its seat 227 and pour the desired laundry treatment products, e.g. detergent and/or softener (depending on the washing cycle he/she wishes the machine to perform) into the proper containers 201*a* and/or 201*b* formed in the drawer 125. When the drawer 125 is pulled out, as in FIGS. 2A and 2C, the elbow portions 221 of the suction pipes 213*a* and 213*b* are extracted from the respective valve bodies 235*a* and 235*b;* the bias springs 249 bias the valve members 241 into a position in which the aperture(s) 247 formed in the perimetral walls thereof are not in communication with the liquid chamber 259. When, after having poured the desired treatment products into the containers 201*a* and 201*b* formed in the drawer 125, the user pushes the drawer 125 fully into its seat 227, the two elbow portions 221 penetrates into the first portions 237 of the valve bodies 235*a* and 235*b,* and the rims of the free ends of the elbow portions 221, abutting the rim of the valve members 241, push the latter against the bias action of the bias springs 249. The valve members 241 thus slide rearward until the apertures 247 formed in the perimetral walls thereof open into the liquid chambers 259, and in this way a fluid path is established between the containers 201*a* and 201*b* and the pumps 265*a* and 265*b*. When either the pump 265*a* or the pump 265*b* is activated (according to the timing of the washing program), it sucks a dosed amount of the respective treatment product, detergent and/or softener, from the container 201*a* or 201*b* formed in the drawer 125; the treatment product is then delivered to the mixing chamber 269, where it may be mixed with cold or hot water taken in from the water mains, and the mix thus obtained is then delivered to the washing tub.

The two containers 201*a* and 201*b* provide a bulk storage of laundry treatment products within the appliance; the capacity of the containers 201*a* and 201*b* may be higher than the amount of laundry treatment product necessary for one washing cycle, and may suffice for several washing cycles, so that the user no longer needs to pour into the appliance the laundry treatment products before starting every washing cycle. An auto-dosing of the treatment products is achieved thanks to the provision of the pumps 265*a* and 265*b,* which take from the containers 201*a* and 201*b* the precise amount of treatment product needed for the single washing cycle; this translates into a saving of laundry treatment products, with a beneficial impact also on the environment.

The proper doses of treatment products are taken from the containers 201*a* and 201*b* in the drawer 125 by the suction action of the pumps 265*a* and 265*b,* i.e. the treatment products do not fall by gravity from the containers. The suction is from above the level of the surface of the treatment products stored in the containers, i.e. the dose of treatment product to be delivered to the washing tub is raised above the surface level. This allows avoiding any possible leakage of treatment products.

The water load chamber 272 provides a separation between the outlets of the electrovalves 270 and 271 and the mixing chamber 269 where the pipes 267*a* and 267*b* from the pumps 265*a* and 265*b* open. In this way, it is ensured that no laundry treatment product leaks into the electrovalves and returns to the cold/hot water mains.

The drawer results in fluid communication with the washing tub only through the pumps, thus vapours that originate in the tub during the laundry washing cannot be discharged through the drawer. The air space 273 in air communication with the washing tub defines a vapours discharge path that allows discharging vapours coming from the washing tub during the washing cycles; the vapours are discharged into the machine cabinet. The discharge of the vapours also prevents that the laundry treatment products stored in the containers 201*a* and 201*b* of the drawer 125 are heated up by the vapours, which is believed to be undesirable, since repeatedly heating up the laundry treatment products might alter their properties.

An advantage of this solution resides in that when the drawer 125 is pulled out of the seat 227 for, e.g., the replenishment of the treatment products containers 201*a* and 201*b,* any possible leakage of treatment products from the valve bodies 235*a* and 235*b* (i.e., residues of treatment product in the valve bodies) drops onto the cap 209, from where it can be easily removed by the user.

The drawer seat 227, the mixing chamber 269, the water load chamber 272, the manifold 277 may be formed as a single-piece component, obtained by a plastic injection-moulding process; this reduction of separated parts simplifies assembling operations.

FIGS. 3A-3L show another solution according to an embodiment of the present invention.

Figure 3A:
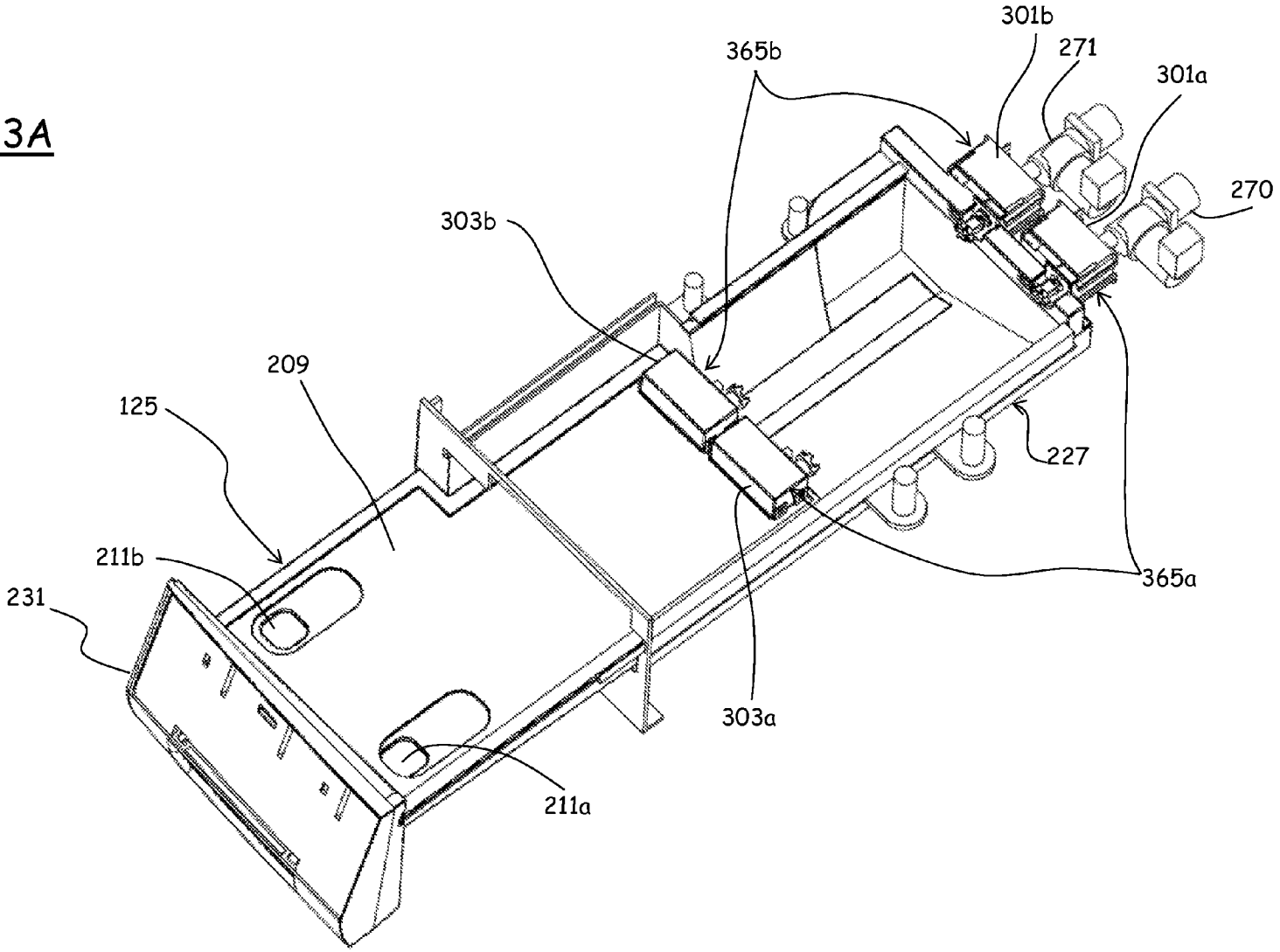
Figure 3B:
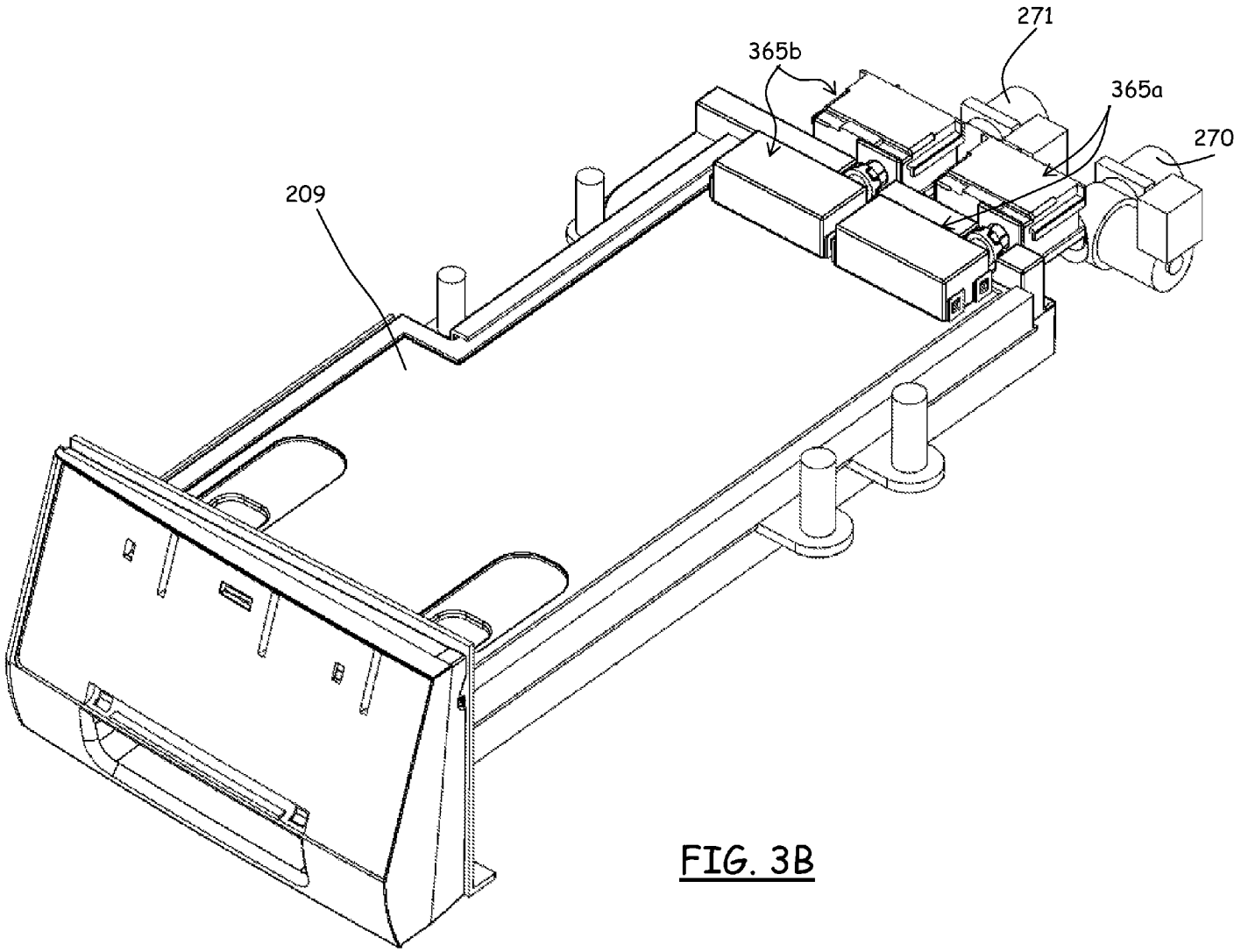
Figure 3C:
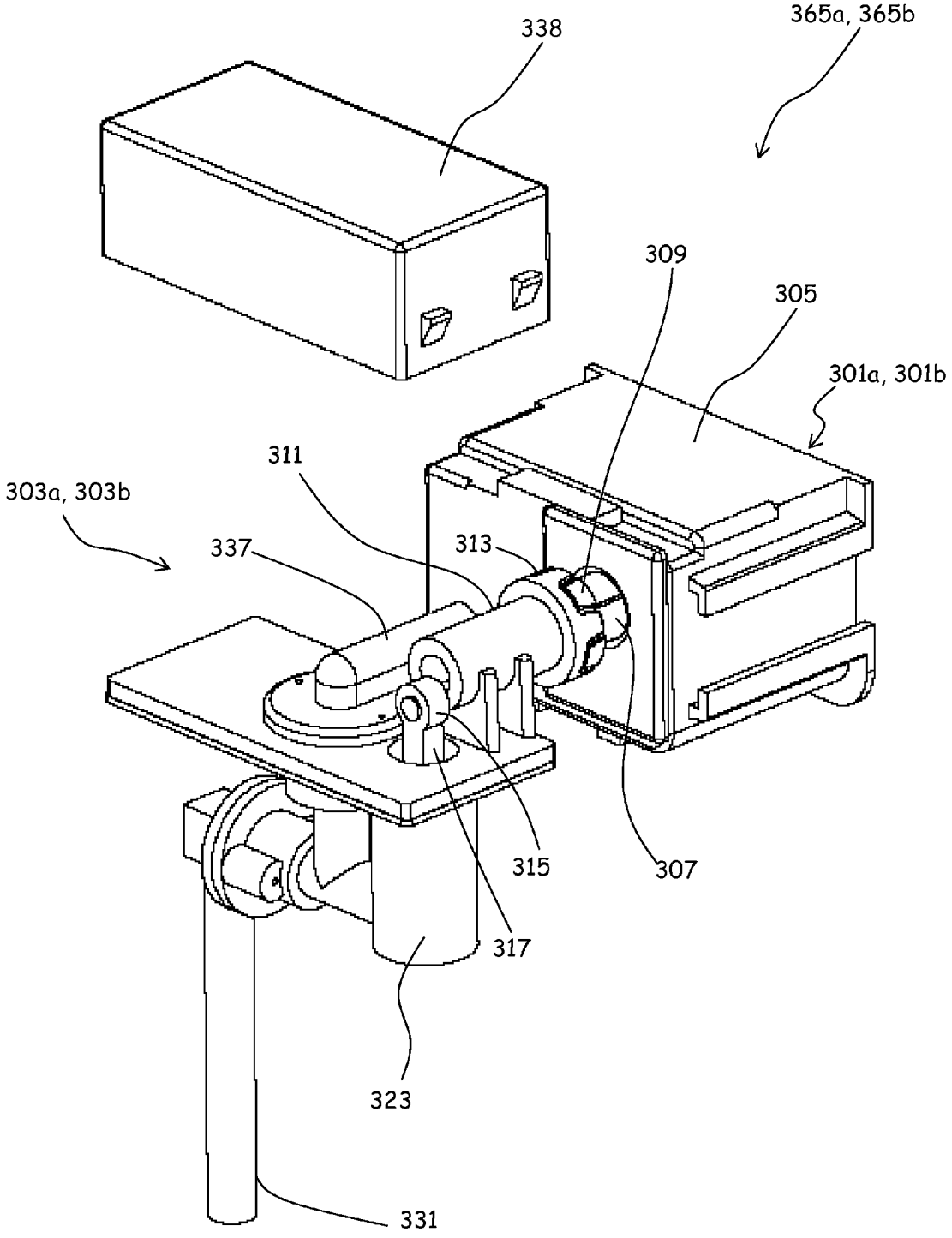
Figure 3E:
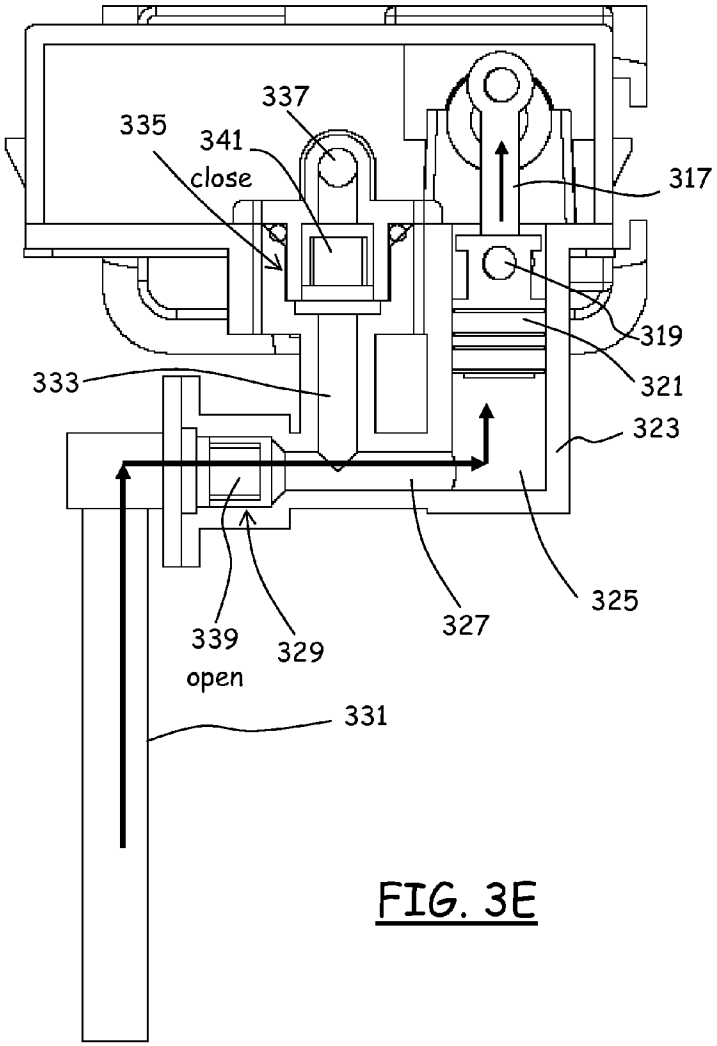
Figure 3D:
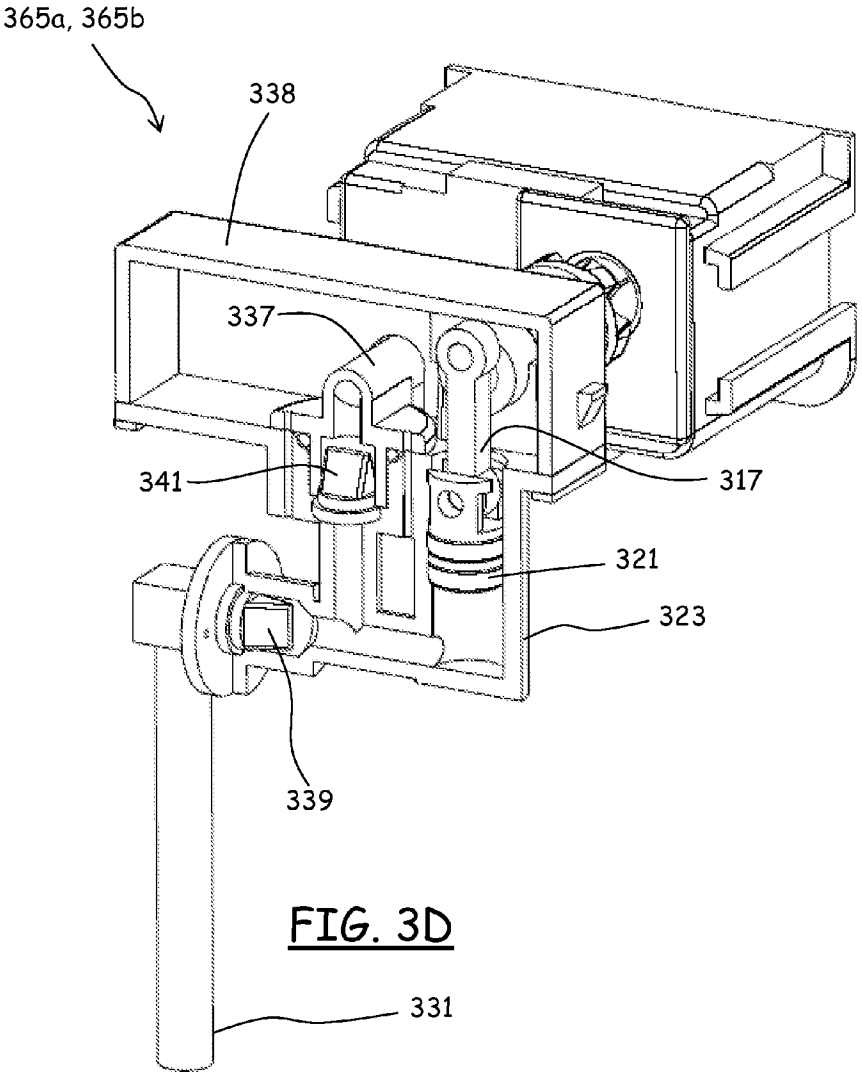
Figure 3G:
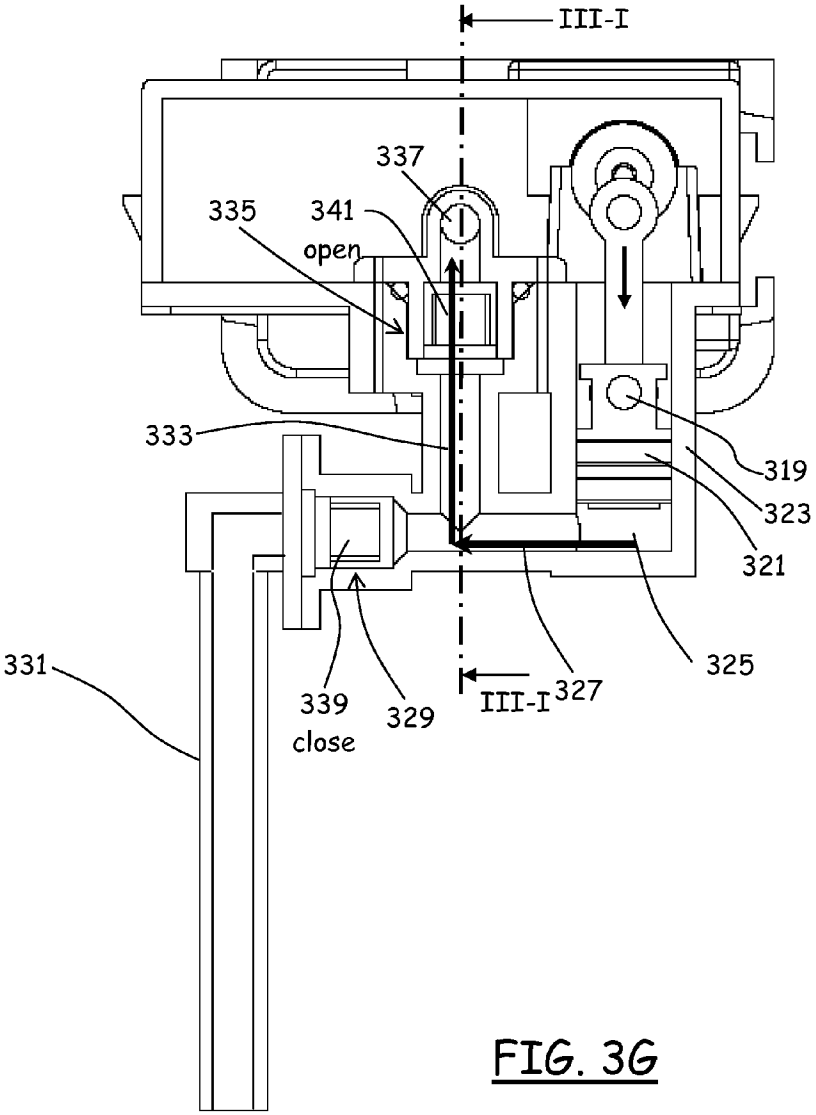
Figure 3F:
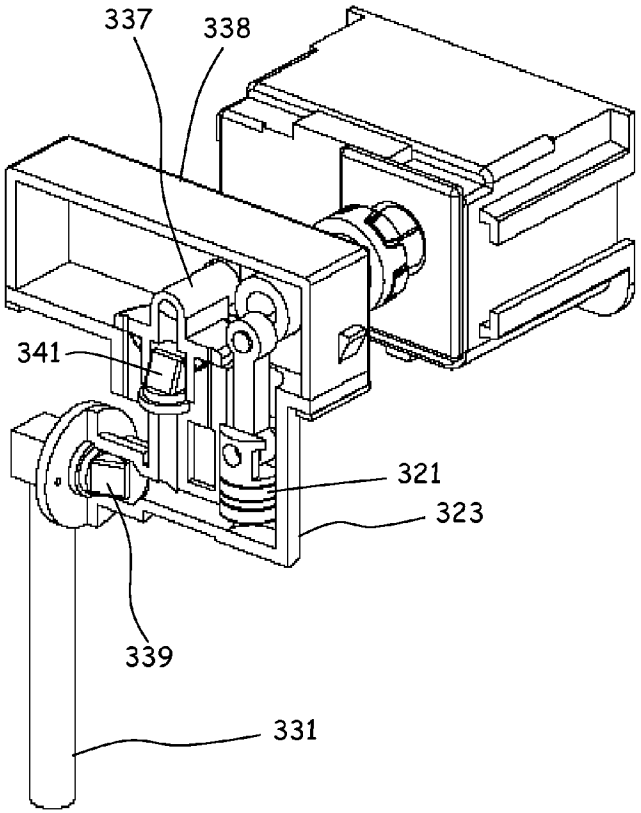
Figure 3L:
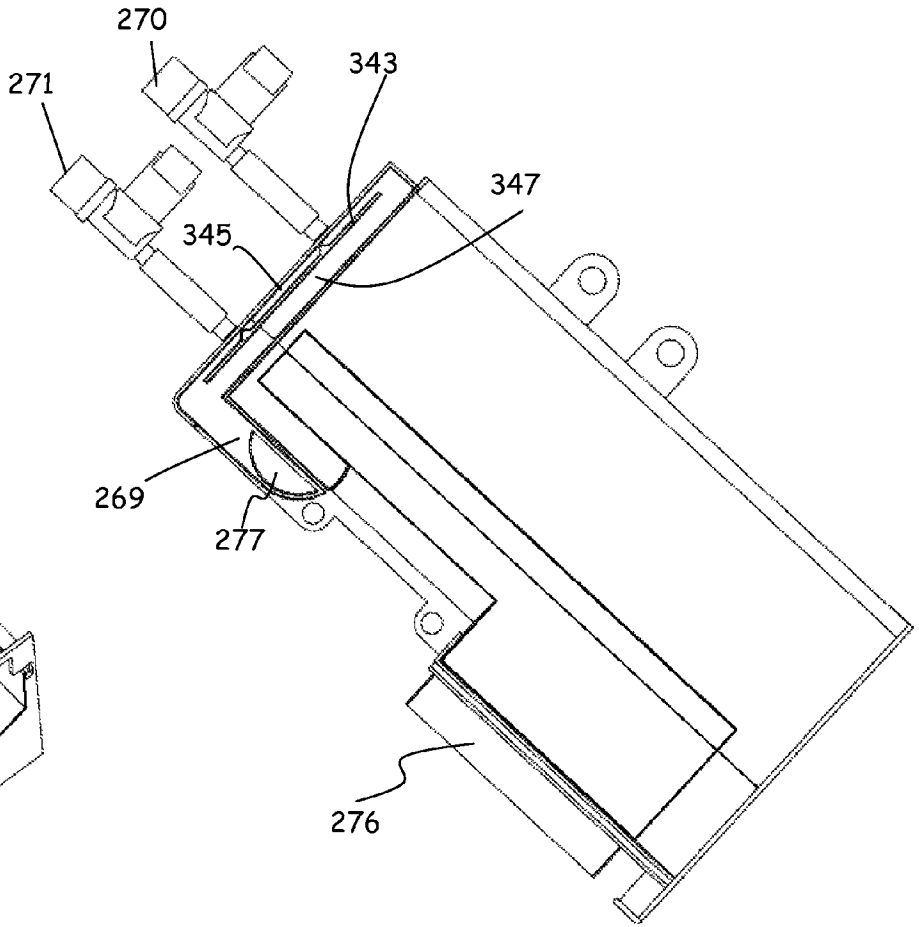
Figure 3H:
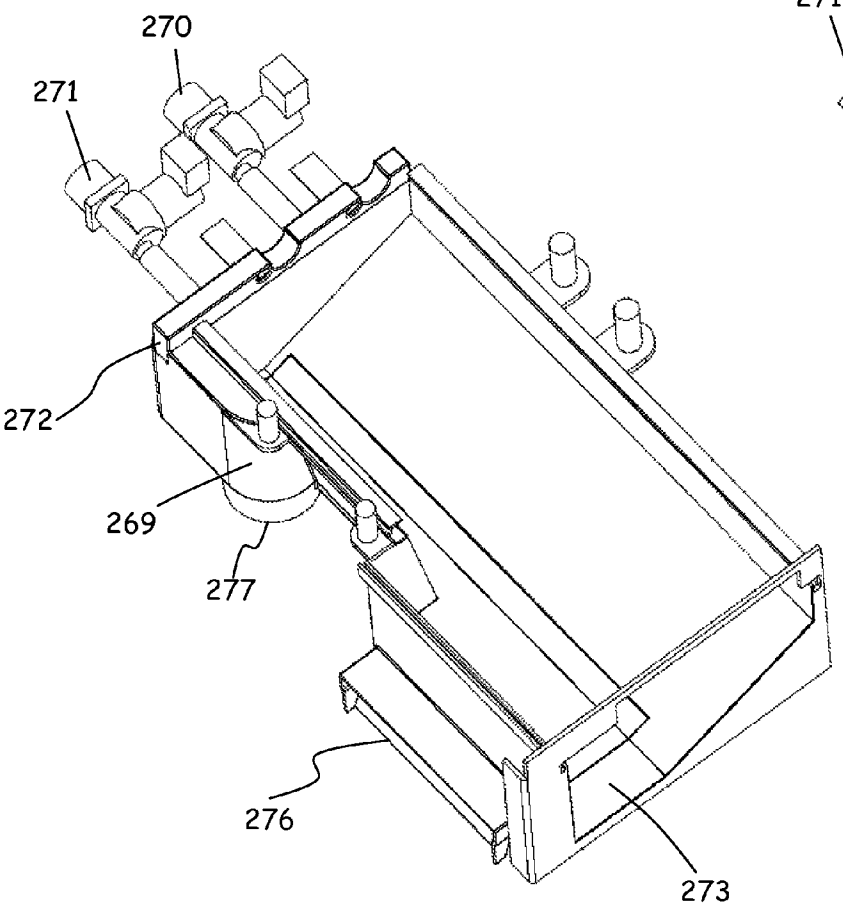
Figure 3I:
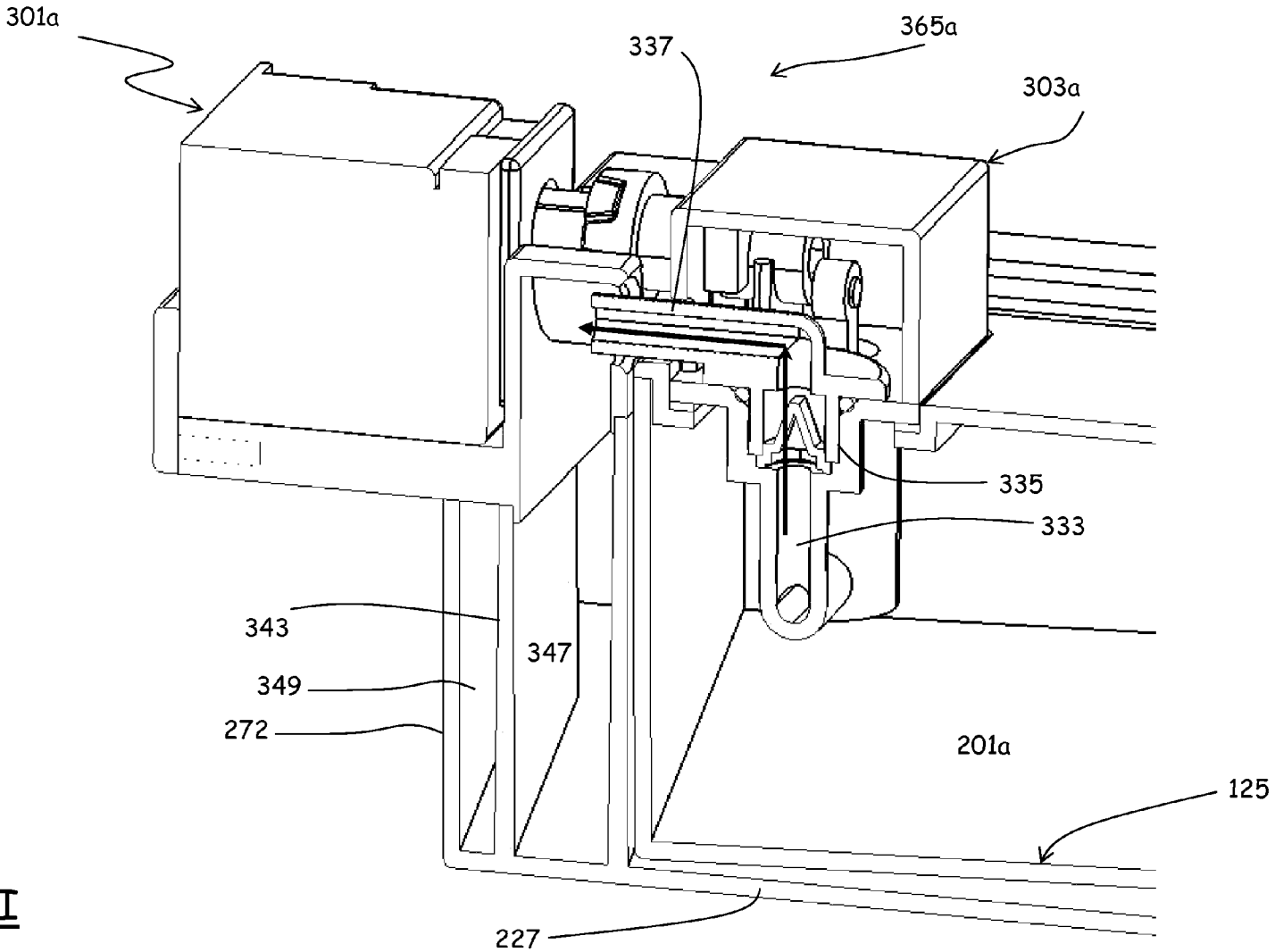

In greater detail, FIG. 3A shows in perspective view the drawer for pouring laundry treatment products partially extracted from its seat; FIG. 3B shows in perspective the drawer fully inserted into its seat; FIG. 3C shows in perspective the detail of a dosing pump for delivering dosed amounts of laundry washing treatment products to a washing tub; FIG. 3D shows the dosing pump, in a perspective similar to FIG. 3C and in partial cross-section, in a first operating condition; FIG. 3E is a front view of the perspective view of FIG. 3D; FIG. 3F shows the dosing pump, in a perspective and in partial cross-section similarly to FIG. 3C, in a second operating condition; FIG. 3G is a front view of the perspective view of FIG. 3F; FIG. 3I shows in perspective and partially in cross-section the dosing pump, in the second operating condition; FIG. 3H is a perspective view of the drawer seat; and FIG. 3L shows in perspective a cross-section of the drawer seat taken along a horizontal plane.

Essentially, this solution differs from that described in the foregoing for the fact that the two suction pipes 213*a* and 213*b,* the two valves formed in the drawer seat 227, and the two suction pumps 265*a* and 265*b* are replaced by two pumps 365*a* and 365*b* having the structure described in the following.

Each of the two pumps 365*a,* 365*b* comprises a pump motor part 301*a,* 301*b,* and a pump body part 303*a,* 303*b*. The pump motor part 301*a,* 301*b,* and the pump body part 303*a,* 303*b* of each of the two pumps 365*a* and 365*b* are separable from one another.

The pump motor parts 301*a* and 301*b,* each comprising a casing 305 accommodating an electric motor, particularly a step-by-step motor, are mounted to the drawer seat 227, at the rear thereof. A driving axle 307 protrudes from the casing 305 of each pump motor part 301*a*, 301*b*, towards the front of the drawer seat 227. At the free end of the driving axle 307, a face gear 309 is mounted.

The pump body parts 303*a* and 303*b* are mounted to the drawer 125, at the rear thereof, onto the cap 209, and are each one in alignment with the respective pump motor part 301*a*, 301*b*.

Each of the pump body parts 303*a* and 303*b* comprises a motion transmission axle 311 terminating at one end thereof with a face gear 313 adapted to releasably mesh with the face gear 309 of the corresponding pump motor part 301*a*, 301*b*. The big end 315 of a connecting rod 317 is pivotally connected to the opposite end of the transmission axle 311, in eccentric position (with respect to a rotation axis of the transmission axle 311). The small end of the connecting rod 317 is hinged to a pin 319 of a piston 321 slidable vertically within a cylinder 323.

The bottom part 325 of the cylinder 323 interior is fluidly connected, through a channel 327, to a first non-return valve 329 arranged at an opposite end of the channel 327 and interposed between the channel 327 and a suction pipe 331 extending downwards into a respective one of the two containers 201*a* and 201*b*.

A vertical channel 333 branches off from the channel 327 in intermediate position along the length of the latter. A second non-return valve 335 is placed along the vertical channel 333; the second non-return valve 335 is interposed between the channel 333 and a delivery channel 337, opening into the water load chamber 272 at the top thereof.

Each of the first and second non-return valves 329 and 335 comprises a respective fluid passage cut-off movable member 339, 341; the generic movable member 339, 341 is movable between a first position, in which it closes a valve passage and thus cuts off the fluid passage, and a second position in which it opens the valve passage and thus does not prevent the fluid passage.

The movable members 339 and 341 are caused to move by pressure deltas induced in the channels 333 and 337 as a consequence of the movement of the piston 321 within the cylinder 323. When the pump electric motor is activated to cause the rise of the piston 321 towards the top dead center (a condition depicted in FIGS. 3D and 3E), the depression induced within the channels 327 and 333 causes the movable member 339 of the first non-return valve 329 to move to the position in which the valve passage is open, while the movable member 341 of the second non-return valve 335 is caused to move to the position in which it closes the valve passage; the same depression causes the washing treatment product to be sucked from the container 201*a*, 201*b* into the channel 327 through the suction pipe 331. When the pump electric motor is activated to cause the down stroke of the piston 321 within the cylinder 323 towards the bottom dead center (a condition depicted in FIGS. 3G, 3I and 3H), the pressure rise within the channel 327 pushes the (liquid) treatment product present within the channel 327 back, so that on one hand the movable member 339 is caused to move to the position in which the valve passage is closed, and, meanwhile, the treatment product raises along the channel 333; here, the movable member 341 is caused to move (by the treatment product itself) to the position in which the valve passage is open, so that the treatment product can flow into the delivery channel 337, and from here into the water load chamber 272. The transmission axle 311 and the delivery duct 338 are covered by a removable box-shaped cap 338.

Preferably, in order to separate the electrovalves 270 and 271 from the laundry treatment products, a vertical baffle 343 is provided within the water load chamber 272, to separate a first sub-chamber 345, whereinto the fresh water is loaded, from a second sub-chamber 347, where the treatment products delivered through the delivery channels 337 are discharged. The baffle 343 extends slightly less than the water load chamber 272, so that the two sub-chambers 345 and 347 are in fluid communication at their ends.

Advantageously, similarly to the previously described embodiment, the water load chamber 272, the vertical baffle 343, the mixing chamber 269 and the manifold 277 are realized in single-piece construction with the drawer seat 227, by means of a plastic injection-moulding process.

Also in this case, level sensors (not shown in the drawings) for sensing the level of laundry treatment products may be provided within, or be operatively associated with the two containers 201*a* and 201*b*.

The user may extract the drawer 125 from its seat 227 and pour the desired laundry treatment products, e.g. detergent and/or softener (depending on the washing cycle he/she wishes to be performed by the machine) into the proper containers 201*a* and/or 201*b* formed in the drawer 125. When the drawer 125 is pulled out, as in FIG. 3A, the face gear 313 of the transmission axle 311 disengages from the face gear 309 on the driving axle 307. After having replenished the containers 201*a* and 201*b*, the user pushes the drawer 125 into its seat 227; the face gear 313 engages the face gear 309 (this engagement may be facilitated by a suitable design of the profile of the teeth of the two face gears 309 and 313).

During the washing cycle, when it is necessary to deliver the washing treatment products to the washing tub, either one of the pump electric motors is activated. The pump sucks from the associated container 201*a*, 201*b* in the drawer 125 a dosed amount of laundry washing treatment product, which is discharged into the sub-chamber 347. Fresh (cold or hot) water is loaded into the sub-chamber 345 by activating either one of the electrovalves 270 and 271. A flash of water passes into the sub-chamber 347 and transports the laundry treatment products to the mixing chamber 269; here, the laundry treatment product mixes with water, and the mix is delivered to the washing tub.

An advantage of this second embodiment is that it requires less parts, in particular less pipes.

Similarly to the first embodiment described in the foregoing, also in this case a dosed amount of treatment product to be delivered to the washing tub is sucked out from the respective container from above the level of the surface of the treatment product stored in the container, i.e. there is no fall by gravity, and this prevents undesired leakages of products.

The invention claimed is:

1. A laundry washing appliance comprising a cabinet accommodating a laundry washing tub and a dispensing arrangement for dispensing laundry washing treatment products to be used during laundry washing, the dispensing arrangement comprising:

a drawer slidable within a drawer seat provided in the cabinet, the drawer defining at least one container for containing laundry washing treatment products;

at least one suction pump associated with the at least one container and fluidly connected to the laundry washing tub for delivering thereto dosed amounts of the treatment products from the at least one container; and a fluid connection between the at least one suction pump and the at least one container, wherein the at least one suction pump and the fluid connection are arranged so as to enable the suction of the dosed amounts of treatment product upwardly from the at least one container, and the at least one suction pump comprises a pump motor part and a pump body part separable from one another, the pump motor part being mounted to the drawer seat, and the pump body part being mounted to the drawer, said pump body part and said pump motor part each comprising a motion transmission member for transmitting motion of the pump motor part to the pump body part when those parts are engaged, said pump motor part and said pump body part being configured to separate from each other as a result of withdrawal of the drawer from the drawer seat.

2. The laundry washing appliance of claim 1, wherein the at least one suction pump is arranged so that in operation it results in the suction of the dosed amounts from above a surface level of the treatment product contained in the at least one container.

3. The laundry washing appliance of claim 1, wherein the pump motor part is mounted at a rear of the drawer seat, and the pump body part is mounted at a rear of the drawer.

4. The laundry washing appliance of claim 1, wherein the dispensing arrangement comprises a mixing chamber, the at least one suction pump associated with the at least one container being fluidly connected to the mixing chamber for delivering thereto dosed amounts of the treatment products from the at least one container, the mixing chamber being fluidly connected to a water inlet and to the laundry washing tub.

5. The laundry washing appliance of claim 4, further comprising a water feed channel connected to an outlet of at least one electrovalve which in use is connectable to an external water main, the water feed channel being fluidly connected to the mixing chamber.

6. The laundry washing appliance of claim 5, wherein the at least one suction pump associated with the at least one container is fluidly connected to the water feed channel for delivering thereto dosed amounts of the treatment products sucked from the at least one container.

7. The laundry washing appliance of claim 6, wherein the water feed channel comprises a first sub-chamber, whereinto fresh water is loadable, and a second sub-chamber, where the dosed amounts of treatment products delivered by the at least one pump are discharged, the first and second sub-chambers being partially separated from one another.

8. The laundry washing appliance of claim 7, wherein the mixing chamber is interposed between the pump motor part and the pump body part.

9. The laundry washing appliance of claim 5, wherein the mixing chamber is interposed between the pump motor part and the pump body part.

10. The laundry washing appliance of claim 5, wherein the mixing chamber and/or the water feed channel are in single-piece construction with the drawer seat.

11. The laundry washing appliance of claim 1, wherein the at least one suction pump is a positive displacement pump.

12. The laundry washing appliance of claim 11, wherein:

the pump motor part comprises an electric motor and a drive axle, and the pump body part comprises:

a motion transmission axle configured to releasably engage the drive axle, a piston driven by the motion transmission axle and movable within a pump chamber, a first non-return valve at an intake of the at least one suction pump, and a second non-return valve at a delivery outlet of the at least one suction pump, wherein the first and second non-return valves are caused to open and close in phase opposition by pressure deltas caused by the movement of the piston within said pump chamber.

13. The laundry washing appliance of claim 1, comprising at least one valve for fluidly connecting the at least one container to the at least one suction pump, said valve being realized so as to automatically close and cut off the fluid connection between the at least one container and the at least one suction pump when the drawer is at least partially extracted from the seat, and to automatically open and establish the fluid connection between the at least one container and the at least one suction pump when the drawer is pushed into the seat.

14. The laundry washing appliance of claim 13, wherein the at least one valve comprises at least a valve portion that is attached to the drawer seat, said valve portion being arranged at the top of the drawer seat, so that the drawer is slidable within the seat below the at least one valve.

15. The laundry washing appliance of claim 14, wherein said at least one valve comprises:

at least one valve body;

at least one fluid passage cut-off member movable within the valve body between a first position in which the fluid passage is cut off, and a second position in which the fluid passage is enabled;

a respective bias member associated with the at least one fluid passage cut-off member for biasing it into the first position when the drawer is at least partially extracted from the seat, and a push member for pushing the bias member into the second position against the action of the bias member when the drawer is pushed into the seat.

* * * * *